United States Patent [19]

Fasano

[11] Patent Number: 4,932,787

[45] Date of Patent: Jun. 12, 1990

[54] STEADY BEARING FOR MIXERS

[75] Inventor: Julian B. Fasano, Englewood, Ohio

[73] Assignee: Chemineer, Inc., Dayton, Ohio

[21] Appl. No.: 315,990

[22] Filed: Feb. 27, 1989

[51] Int. Cl.[5] ..... B01F 7/18

[52] U.S. Cl. ..... 366/246; 366/249; 366/314; 366/279; 384/226; 384/249

[58] Field of Search ..... 366/98, 245, 247, 249, 366/253, 314, 302, 279, 246; 384/226, 249

[56] References Cited

U.S. PATENT DOCUMENTS 3,443,794 5/1969 Peterson .

3,580,547 5/1971 Amorese .

*Primary Examiner*—Frankie L. Stinson

*Attorney, Agent, or Firm*—Biebel, French & Nauman

[57] ABSTRACT

A steady bearing for supporting the extended end of an impeller shaft at the bottom of a mixing vessel provides adjustment for the alignment of the position of the shaft within the vessel and includes a bearing support stand with legs extending to the bottom of the tank or vessel, and a plate which is supported off of the bottom. A steady bearing housing has a bearing sleeve which receives the end of the shaft and has a mounting flange which extends radially of the housing and is mounted or received in abutting relation to the bearing support plate. Couplers in the form of slotted circular discs are received in recesses in the bearing housing mounting flange. The slots have threaded fasteners which extend therethrough and into the support plate, so that the radial position of the steady bearing housing with respect to the support stand may be made accompanied by rotational movement of the coupler discs within their respective recesses. Thereafter, the fasteners are tightened down to maintain the adjustable position. The steady bearing may be adjusted either from a position within the tank or through an opening in the bottom of the tank.

5 Claims, 3 Drawing Sheets

STEADY BEARING FOR MIXERS

BACKGROUND OF THE INVENTION

This invention relates to mixing apparatus, and more particularly to a steady bearing for such apparatus. In many installations, where a mixer is mounted on a tank mounting flange with an agitator shaft extending into the interior of a tank or vessel, the contents of which are to be mixed or blended, it is desirable to support the extended end of the impeller shaft within the interior of the tank. Typically, such supports for the extended end of impeller shafts are known as steady bearings or steady bearing supports.

A steady bearing usually has a bearing housing and a support for mounting the bearing housing on an interior tank surface, such as at the bottom of the tank. The bearing housing typically includes a sleeve-type bearing member within which the extended end of the shaft is received and supported. The shaft extended end is usually provided with a wear sleeve which cooperates with the bearing sleeve.

A particular problem exists in the positioning and mounting of such steady bearings within large agitator tanks. It will be appreciated that the agitator shaft, itself, will deviate from the true center of the tank with any slight misalignment or error in the parallelism of the mounting flange, at the top of the tank, in relation to the position of the steady bearing. Further, since it is usually necessary for the steady bearing to be mounted from within the tank, such as by a person descending into the interior of the tank, or be mounted through a bottom access opening in the tank bottom, the exact position of the impeller shaft, after the mixer drive head has been mounted on its mounting flange, cannot always be predicted with great accuracy.

The problem of alignment, both radially and axially, is usually dealt with by shimming the bearing support and/or shimming the mixer head at its mounting flange. This can be a tedious and time consuming task. Often, the installation does not provide sufficient flexibility to achieve proper alignment by shimming alone. This is especially true for bottom supported shafts which exceed 20 feet in length.

There has been a tendency, in industry, simply to force the extended end of the shaft to fit within the steady bearing, such as by causing the shaft to deflect somewhat. Obviously, such deflection is generally undesirable, not only because of the undue wear to which the steady bearing can be subjected, but also due to the flexing within the shaft as it is rotated.

There is accordingly a need for a steady bearing which permits and provides radial positioning through 360 of its center axis, to provide for alignment of the bushing with the actual position of a shaft within a mixing vessel.

SUMMARY OF INVENTION

This invention is directed to a steady bearing for supporting the extended end of an impeller shaft, such as at the bottom of a mixing vessel, and provides adjustment of the alignment of the bearing to the radial position of the shaft.

The apparatus of this invention is adapted to be mounted on an inside surface of such a vessel, usually at the bottom, and is adapted to be adjusted from a position either within the interior of the vessel, or external to the vessel, as conditions require. The apparatus includes a bearing support stand. The stand is provided with legs which extend from a support plate to the tank surface, so that the support plate is supported on the legs in somewhat spaced relation to the surface.

A steady bearing housing carries a bearing sleeve or bushing which is adapted to be received over a suitably bushed terminal end of the shaft. The bearing housing has a mounting flange which extends radially from the housing, which flange is adapted to be received in abutting relation to a mounting surface formed on the support plate of the bearing support stand. Typically, the bearing support stand is annular, with a central opening therethrough, and when the steady bearing housing is positioned on the stand, a portion of the bearing sleeve and/or the shaft may extend through the opening. The opening is larger than the diameter of the bearing sleeve and sleeve support, to permit the mounting flange of the bearing housing to be moved radially of the center axis in any direction.

Couplers connect the bearing housing to the support stand. These couplers are in the form of a plurality of circular discs. Each of these discs is formed with an elongated, generally radially extending slot, so that the slot is offset from the center of the disc. The bearing housing mounting flange is provided with recesses which receive the coupling discs. The recesses are distributed in a circular array about the center axis so that each disc is substantially uniformly spaced from each other and from the center axis.

Threaded fasteners extend through the discs and fasten into the support stand. These fasteners are arranged to be accessible either through the interior of the tank, or through the tank bottom, simply by reversing the relative position of the legs on the bearing support stand, and then inverting the interfitting parts. The positioning of the steady bearing housing mounting plate on the bearing support stand, within the limits provided by the offset slot, is accomplished by suitably shifting the steady bearing housing radially of its axis accompanied by rotational movement of the respective discs. Thereafter the threaded fasteners are tightened to clamp the bearing housing in its adjusted position on the support stand.

The apparatus of this invention greatly simplifies installations of mixer shafts in tanks, particularly for large installations, such as where the shaft has an unsupported length of twenty feet or more.

It is therefore an object of this invention to provide a steady bearing which may be adjusted radially through 360° of its center axis, to provide for alignment with the radial position of a shaft within a mixing vessel.

A further object of the invention is the provision of a steady bearing for supporting the extended end of an impeller shaft within a mixing vessel in which a bearing support stand is mounted on legs in spaced relation to the bottom wall of the vessel, and a steady bearing housing is mounted on the bearing support through a plurality of disc-shaped couplers, in which the couplers are provided with radially-extending, offset slots, and threaded fasteners extend through the slots, permitting the adjustment of the position of the bearing housing with respect to the support, by rotating the couplers.

These and other objects and advantages of the invention will be apparent from the following description, the accompanying drawings, and the appended claims.

BRIEF DESCRIPTION OF ACCOMPANYING DRAWINGS

DESCRIPTION OF THE PREFERRED EMBODIMENT

Figure 1:
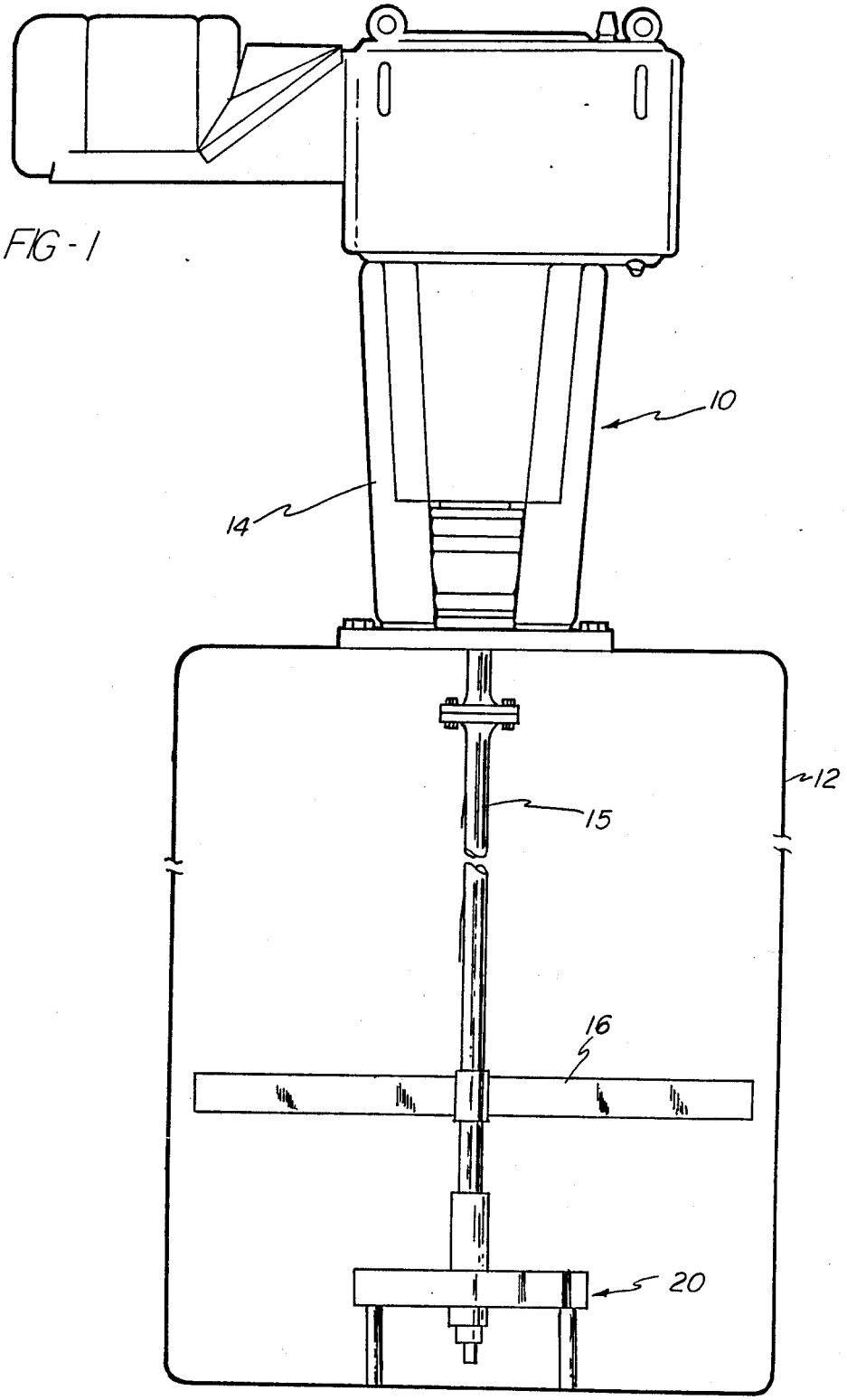
FIG. 1 is a diagram of a top-mounted agitator with an extended propeller shaft, in which a steady bearing is employed at a tank bottom for support the extended end of the impeller shaft.

Referring to the figures of the drawing which represent a preferred embodiment of the invention, a top entry mixer, to which the invention may be applied, is illustrated generally at 10 in FIG. 1. The mixer is mounted on a mixing vessel or tank 12 having an upper mounting flange on which a mixing head 14 is mounted. The mixer head 14 drives a depending shaft 15 which extends into the interior of the tank 12. The shaft 15 drives one or more impellers 16, and the remote end of the shaft is stabilized by a steady bearing illustrated generally at 20. It will be understood that the shaft 15 may be of substantial length, such as in excess of 20 feet.

Figure 2:
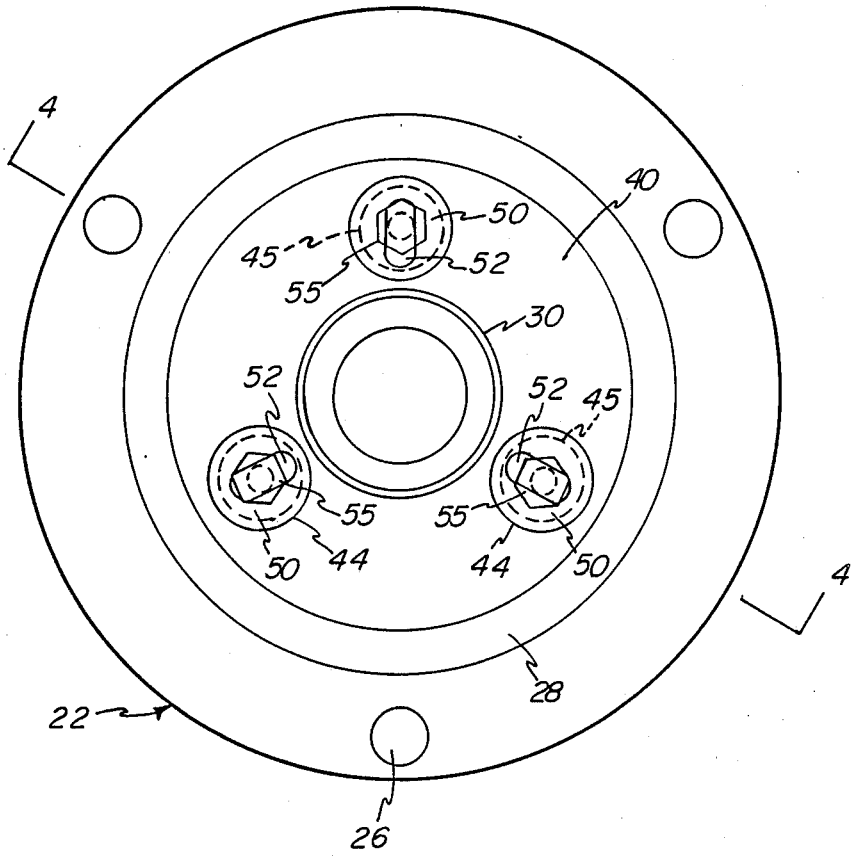
FIG. 2 is a top plan view of the steady bearing of this invention.
Figure 3:
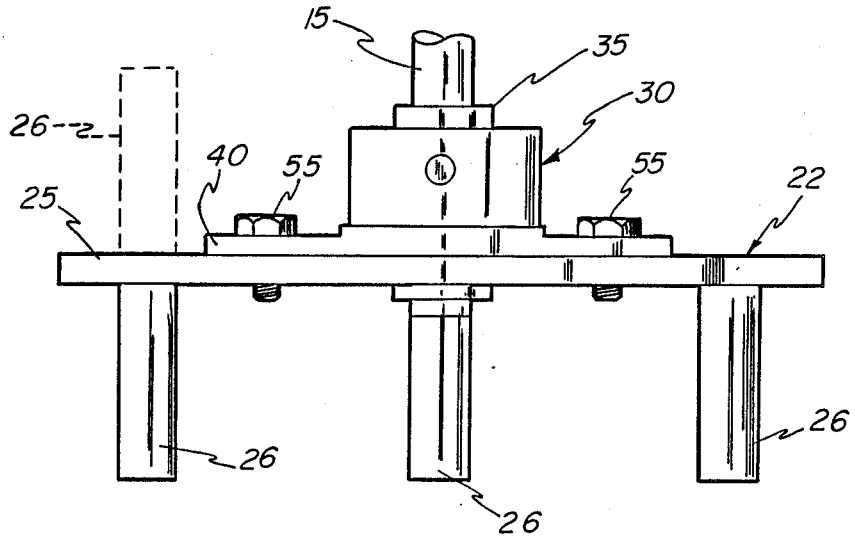
FIG. 3 is a side elevation thereof.
Figure 4:
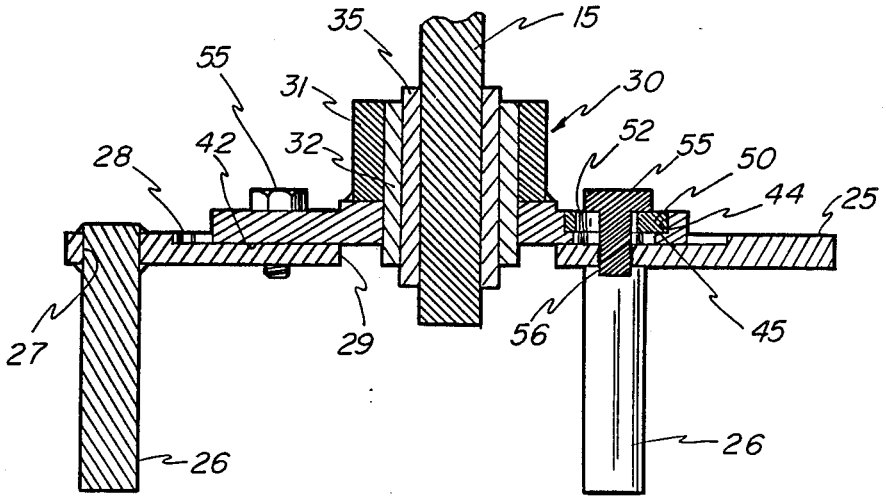
FIG. 4 is a section taken generally along the line 4—4 of FIG. 2.

The steady bearing 20 of this invention is illustrated in FIGS. 2–4 and is formed by three major components. The first component is a bearing support stand 22. The stand 22 is proportioned to be received within the mixing vessel or tank, and is formed with a generally annular bearing support plate 25 on which depending legs 26 are mounted. As shown in FIG. 4, three legs 26 extend through openings 27 in the margin of the plate 25 and are welded in place, and provide the means by which the bearing support stand 22 may be mounted to an inside surface of the tank, such as at the bottom of the tank. The legs 26 accordingly support the plate 25 in spaced relation to the tank bottom.

The upper face of the bearing support stand is generally flat and is formed with a slightly recessed bearing housing mounting surface 28 surrounding a central opening 29. A circular steady bearing housing 30 is received on the surface 28. The diameter of the bearing housing 30 is less than that of the recessed surface 28, to permit the bearing housing to be positioned radially with respect to the axis of the support stand plate 25 on the surface 28.

The steady bearing housing 30 is formed with a central bearing support portion 31 which contains a bearing sleeve bushing 32 therein. Typically, the bushing 32 may be formed of glass-filled Teflon (PTFE) or other high molecular weight bearing material which will be lubricated by the contents of the tank being agitated or mixed.

The bushing 32 receives the shaft 15 therethrough, and typically the shaft 15 is provided with a replaceable wear sleeve 35 at its extended end for running engagement with the bushing 32.

The bearing housing 30 has a generally plate-like radially extending mounting flange 40 which extends outwardly from the bearing sleeve 31, and has a lower radially flat surface 42 which mates with and rests against the surface 28 of the support stand. The diameter of the mounting flange 42 is less than that of the surface 28, to provide for radial positioning of the bearing housing 30 with respect to the support stand 20.

The mounting flange 40 has a plurality of recessed openings 44 formed in its upper surface. The openings 44 are positioned in arcuately spaced relation about the flange, each equally spaced from the other, and each equally spaced radially from the axis of the bushing 32. In the embodiment as illustrated, three such openings 44 are provided at 120° spacing, but it will be understand that a greater number may be employed, if desired.

The openings 44 are shouldered at 45 to receive coupler means in the form of circular washers or discs 50. The discs 50 have a diameter so as to be received within the recesses 44 while resting on the shoulders 45, and may rotate about their respective axes within these recesses. The discs 50, which may be identical, are each formed with an elongated, generally radially-extending slot 52. The slot 52 extends from the center of the disc radially outwardly toward an edge thereof. Thus, the slot 52 may be considered as a radially-extending and offset from the center of the disc.

Each disc 50 is retained by a threaded fastener, such as a hex head machine screw 55. The screws 55 extend through the slots 52 in each of the discs 50 and into tapped openings 56 formed in the plate 25. The tapped openings 56 in the plate 25 are positioned radially and arcuately so as to coincide with the center of the respective recesses 44.

The radial position of the steady bearing housing 30 on the bearing support stand 20 may be conveniently adjusted by sliding the steady bearing housing 30 along the surface 28, accompanied by rotation of the discs 50 within the recesses 44. When the appropriate position is obtained, providing true alignment of the bushing 32 with the shaft wear sleeve 35, the fasteners 55 may be tightened in position, thereby assuring locking of the steady bearing housing to the support stand in the adjusted position.

The apparatus which has been described above is most readily adjustable from a position within the interior of the tank. However, there may be many instances when it is desired to make the adjustment through an access opening in the bottom of the tank, from a position from within the circle defined by the legs 26. The steady bearing of this invention is readily adapted to this use simply by reversing the position of the legs 26 on the plate 25, as shown by the phantom view of a leg 26' in FIG. 3. Then the entire assembly may be inverted with the legs again positioned and supported on the inside wall of the tank at the bottom. Now the discs 50 and the fasteners 55 are at the bottom and may be reached through a conventional bottom opening in the tank for adjustment and tightening, as previously described.

The operation of the invention is largely self-evident from the foregoing description. The ability to position the steady bearing housing 30 on the platform or stand 22, accommodated by the rotation of the individual discs 50 within the recesses, permits a selection of any position of the bearing housing 30 within a full 360° of the center of the support stand 20. When the fasteners 55 are tightened, the adjusted position is assured. The fasteners may be safety-wired, if desired, to assure retention.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A steady bearing for supporting an extended end of an impeller shaft at the bottom of a mixing vessel and providing adjustment of alignment to the position of the shaft within the vessel, comprising:

a bearing support stand proportioned to be received within the vessel and having a bearing support plate, leg means on said plate proportioned to extend to said vessel bottom and to support said plate in spaced relation to such bottom, said plate further having an exposed generally flat bearing housing mounting surface;

a steady bearing housing having a bearing sleeve therein adapted to receive the end of said shaft, said housing having a generally plate-like mounting flange extending radially of said housing and adapted to be received in abutting relation with said plate mounting surface;

coupler means connecting said bearing housing flange to said support stand plate including a plurality of generally circular discs, means in each said discs defining an elongated generally radially extending slot offset from the center thereof;

recess means in said bearing housing mounting flange receiving said discs with the centers thereof generally equally spaced from the axis of said bearing sleeve and providing for rotation of each of said discs so as to position the associated slot therein through 360°;

means in said bearing support plate receiving threaded fasteners one each for each of said discs; and a threaded fastener for each of said discs, each said fastener extending into said support plate through the associated said washer slot and having a head engageable with said washer, whereby the radial position of said bearing housing on said support stand may be varied in accordance with the rotational position of said discs about said fasteners.

2. A steady bearing for supporting an extended end of an impeller shaft in a mixing vessel and providing alignment to the radial position of the shaft within the vessel, comprising:

a bearing support stand proportioned to be received within the vessel and having a bearing support plate, means on said pate proportioned to extend to said vessel wall and to support said plate in spaced relation to such wall, said plate further having an exposed generally flat bearing housing mounting surface;

a steady bearing housing having a bearing means therein adapted to receive the end of said shaft, said housing having a generally plate-like mounting flange extending radially of said housing and adapted to be received in abutting relation with said plate mounting surface;

coupler means connecting said bearing housing flange to said support stand plate including a plurality of generally circular discs, means in each said discs defining a an elongated generally radially extending slot having one end thereof offset from the center of the disc;

recess means in said bearing housing mounting flange receiving said disc with the centers thereof generally equally spaced from the axis of said bearing sleeve and providing for rotation of each of said discs so as to position the associated slot therein through 360°;

means in said bearing support plate receiving fasteners one each for each of said discs; and a threaded fastener for each of said discs, each said fastener extending into said support plate through the associated said washer slot and having a head engageable with said washer, whereby the radial position of said bearing housing on said support stand may be varied in accordance with the rotational position of said discs about said fasteners.

3. The steady bearing of claim 2 comprising three of said recesses and three of said discs, spaced at 120° from an axis through said annular support.

4. The steady bearing of claim 2 in which said fasteners are accessible from within said vessel.

5. The steady bearing of claim 2 in which said fasteners are accessible from a bottom opening in said vessel.

* * * * *